US007594383B2

(12) United States Patent
Fink et al.

(10) Patent No.: US 7,594,383 B2
(45) Date of Patent: Sep. 29, 2009

(54) BALLOON CONTROL RING FOR A TEXTILE MACHINE

(75) Inventors: Heinz Fink, Krefeld (DE); Ludwig Appelhans, Krefeld (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 12/086,825

(22) PCT Filed: Oct. 31, 2006

(86) PCT No.: PCT/EP2006/010460

§ 371 (c)(1),
(2), (4) Date: Jun. 19, 2008

(87) PCT Pub. No.: WO2007/073794

PCT Pub. Date: Jul. 5, 2007

(65) Prior Publication Data

US 2009/0038286 A1 Feb. 12, 2009

(30) Foreign Application Priority Data

Dec. 24, 2005 (DE) ..... 10 2005 062 261

(51) Int. Cl.
*B65H 57/24* (2006.01)

(52) U.S. Cl. ..... 57/354

(58) Field of Classification Search ..... 57/354–356
See application file for complete search history.

(56) References Cited

U.S. PATENT DOCUMENTS

| | | | | | |
|---|---|---|---|---|---|
| 539,561 | A | * | 5/1895 | Whitaker | 57/354 |
| 2,082,450 | A | * | 6/1937 | Heaton | 57/354 |
| 3,316,703 | A | * | 5/1967 | McKelvie | 57/354 |
| 3,410,074 | A | | 11/1968 | Nimtz et al. | 57/108 |
| 3,646,746 | A | * | 3/1972 | Murray et al. | 57/355 |
| 4,397,143 | A | * | 8/1983 | Klein | 57/355 |
| 4,555,900 | A | * | 12/1985 | Klug et al. | 57/355 |

FOREIGN PATENT DOCUMENTS

| | | | |
|---|---|---|---|
| DE | 1 510 844 | | 6/1970 |
| DE | 1 510 869 | | 10/1970 |
| DE | 29 41 160 | A1 | 4/1981 |
| EP | 179003 | A1 * | 4/1986 |
| FR | 1 533 858 | | 9/1968 |

* cited by examiner

*Primary Examiner*—Shaun R Hurley
(74) *Attorney, Agent, or Firm*—K&L Gates LLP

(57) ABSTRACT

A balloon control ring for a textile machine for limiting a circulating yarn balloon, wherein the balloon control ring comprising a metallic hollow cylinder with a wear-resistant surface, is characterised in that the hollow cylinder (2, 23, 37) is formed from a sheet metal strip, the hollow cylinder (2, 23, 37) is held by the end portions (3, 4; 14, 15; 38, 39) of the sheet metal strip, and an edge strip (8, 9; 10, 11; 55, 56) is folded round at the two edges of the hollow cylinder (2, 23, 37), with the sheet metal thickness of the sheet metal strip being at most 0.6 mm.

12 Claims, 5 Drawing Sheets

BALLOON CONTROL RING FOR A TEXTILE MACHINE

CROSS-REFERENCES TO RELATED APPLICATIONS

This application claims the benefit of German patent application 10 2005 062 261.5, filed Dec. 24, 2005, and corresponding International PCT Patent Application No. PCT/EP2006/010460, herein incorporated by reference.

BACKGROUND OF THE INVENTION

The invention relates to a balloon control ring for a textile machine for limiting a circulating yarn balloon, and more particularly wherein the balloon control ring comprises a metallic hollow cylinder with a wear-resistant surface.

So-called balloon control rings are used on two-for-one twisters and ply twisters in order to restrict the circulating yarn balloon formed by the running yarn. At winding machines, the balloon behavior of the yarn drawn from the cop is also influenced by means of the balloon control ring and the yarn tension is kept low.

The use of balloon control rings allows a reduction in the spacing designated the spindle gauge from spindle centre to spindle centre. In this manner, more spindles can be arranged at a textile machine without lengthening the machine.

German Patent Publication DE 1510869 A shows a balloon control ring, the cylindrical shell of which is formed by a ring. The holding takes place by means of solid filler elements which surround the balloon control ring on the entire periphery. The filler elements are in each case fastened to one of two longitudinal profile carriers extending spaced apart. This holding is expensive. The ring has folded over portions to secure its position, which prevent falling from the filler elements. Rings of this type are produced by forming methods such as extrusion or by welding.

It is known, for example, from German Patent Publication DE 2941160 A1, to produce the balloon control ring from formed aluminium or nickel chromium sheet metal. A hollow body produced by extrusion provides the running yarn with a disruption-free circulating path.

A straight bead-welded tube made of rolled sheet metal which is provided with a weld seam at the joint edge and is then pressure-rolled presents an economical finished hollow body for balloon control rings. Designs of this type require relatively thick sheet metal to ensure the stability of the balloon control ring. A sheet metal thickness of this type is also necessary for manufacturing reasons in order to be able to produce the balloon control ring as a deep-drawn part or in order to be able to lay a weld seam.

It is known from German Patent Publication DE 1510844 A to use wear-reducing special steels for balloon control rings, which special steels are however too heavy and too expensive. To avoid this drawback, it is proposed to form solid balloon control rings from aluminium alloys or balloon control rings from foils made of any material and to provide the inner surfaces of the balloon control rings with a chemically applied deposit of a phosphor alloy based on chromium as well as nickel, the hardness of which is at least equal to the hardness of a normal anodising layer of a balloon control ring made of an aluminium alloy. Balloon control rings which comprise foil strips made of metal or plastics material, however, have inadequate dimensional stability.

SUMMARY OF THE INVENTION

The object of the invention is to form a balloon control ring with a low weight, which comprises a wear-resistant metallic hollow cylinder and wherein a high degree of dimensional stability of the hollow cylinder is ensured.

This object is achieved in a balloon control ring for a textile machine for limiting a circulating yarn balloon, wherein the balloon control ring comprises a metallic hollow cylinder with a wear-resistant surface, by forming the hollow cylinder from a sheet metal strip, the end portions of which hold the hollow cylinder, and by providing an edge strip folded round at the two edges of the hollow cylinder. Optimally, the sheet metal thickness of the sheet metal strip is at most 0.6 mm.

To produce the balloon control ring according to the invention, only a small quantity of easily processed material is required. Despite the low weight, good dimensional stability is provided.

This stability can be achieved if an edge strip is folded round at the two edges of the hollow cylinder, in each case, the width of the fold is preferably between 5 mm and 10 mm. The sheet metal thickness of the sheet metal strip, from which the hollow cylinder is produced, is advantageously between 0.3 mm and 0.6 mm. This sheet metal thickness represents an optimum between a low weight and dimensional stability. A further increase in the stability of the cylindrical shape of the hollow cylinder can be achieved by end portions of the sheet metal strips bent round outwardly at right angles and pressed against one another. If the balloon control ring is formed in such a way that the end portions contact a frame wall of the textile machine and an electrically conductive connection is produced by the contact, the undesired electrostatic charge of the balloon control ring, which is produced by friction of the running yarn on the hollow cylinder, is discharged.

The balloon control ring is preferably held by means of a holding element which presses the end portions against one another. If the holding element in this case comprises first level contact faces, with which it abuts the end portions and presses these against one another, as well as at least a second concave contact face, with which it abuts the outer face of the cylinder, and if the balloon control ring is fixed by means of connecting elements which cross the holding element and the end portions, a hollow cylinder according to the invention is additionally stabilised. The second contact face, with which the holding element abuts the outer face of the hollow cylinder, is adapted to the curvature of the hollow cylinder.

The balloon control ring is provided with a secure seat in the holding element by means of free ends of the end portions, which are turned over in such a way that they engage behind the holding element.

Advantageously, the holding element has positioning cams and holding magnets, with which it can be fixed on a frame wall of the textile machine. The positioning cams of the holding element engage in corresponding positioning bores of the frame wall of the textile machine and allow rapid and exact positioning. The holding magnets which are rigidly connected to the holding element ensure, together with the positioning cams, a secure seat of the balloon control ring. The magnetic connection if necessary, can be detached easily and without the use of a tool. The holding element preferably consists of plastics material. A design of the holding element from plastics material has little weight. The holding element can be produced particularly economically from plastics material, for example as an injection moulding.

If the hollow cylinder consists of a thin stainless nickel chromium steel, the wear resistance is high even without an additional surface treatment.

BRIEF DESCRIPTION OF THE DRAWINGS

Further details of the invention can be inferred from the embodiments described with the aid of the figures, in which.

DETAILED DESCRIPTION OF THE PREFERRED EMBODIMENTS

Figure 1:
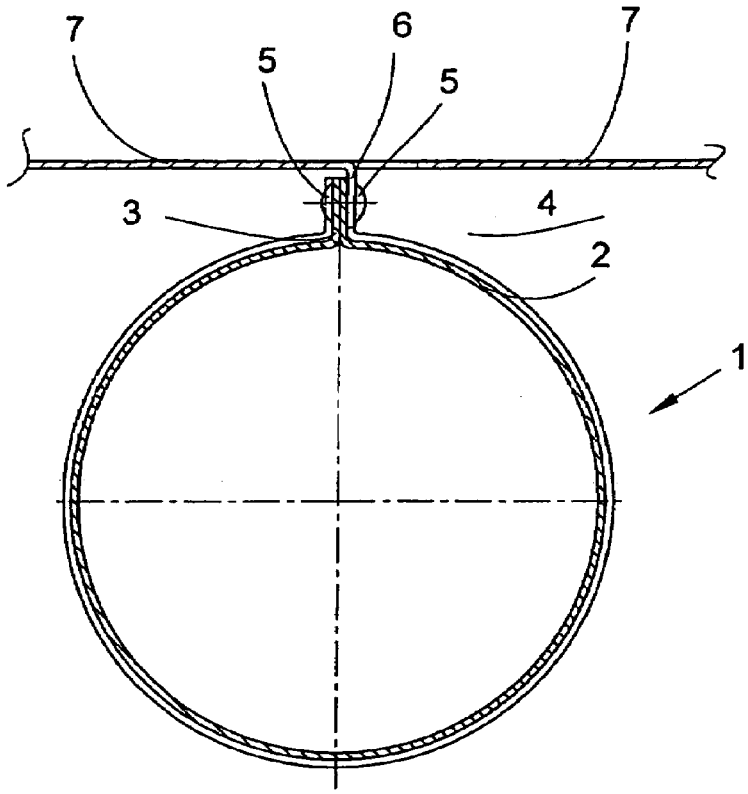
FIG. 1 shows a sectional plan view of a balloon control ring.
Figure 2:
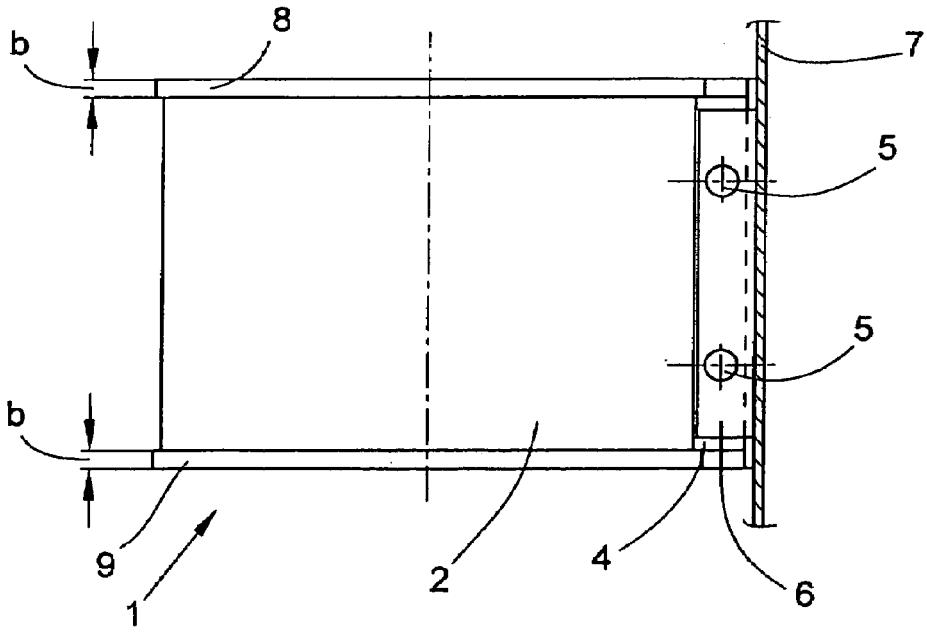
FIG. 2 shows a lateral view of the balloon control ring of FIG. 1.
Figure 3:
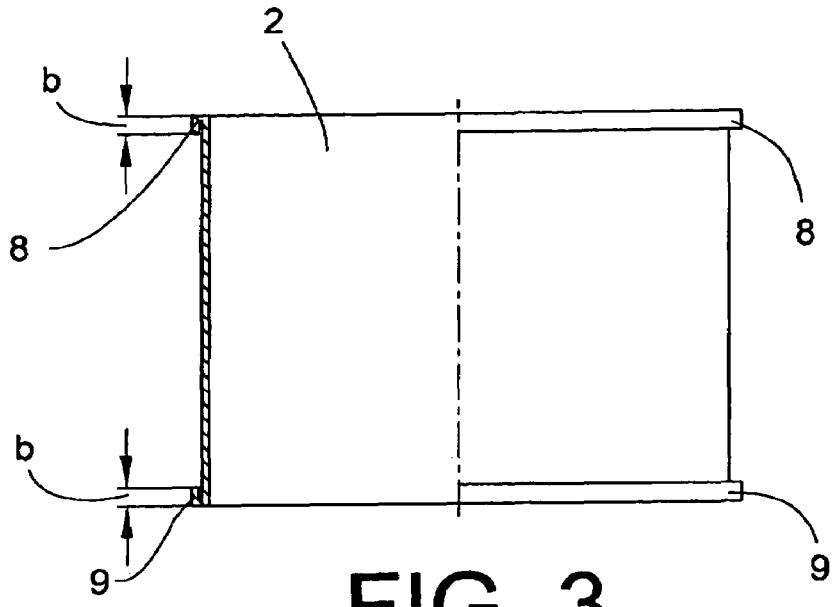
FIG. 3 shows a front view of the balloon control ring of FIG. 1, partially in section.

FIGS. 1, 2 and 3 show a balloon control ring 1 for a textile machine with a hollow cylinder 2. The hollow cylinder 2 is formed from a sheet metal strip. The length of the sheet metal strip is greater than the periphery of the hollow cylinder 2. An edge strip 8, 9 is folded round, in each case, at the upper and lower edge of the hollow cylinder 2. The edge strip 8, 9 may have a width b of 5 mm to 10 mm. An end portion 3, 4 is formed in each case from the longitudinal portion of the sheet metal strip extending beyond the periphery at each of the two ends of the sheet metal strip. The two end portions 3, 4 are of equal length, bent outwardly at right angles and pressed against one another. The end portions 3, 4 are pressed together by a rivet 5 and also rigidly connected to an angled lug 6 of the frame wall 7 of the textile machine. The hollow cylinder 2 is thus held in a simple manner by the end portions 3, 4 of the sheet metal strip which are bent outwardly. The thin sheet metal strip may consist of a nickel chromium metal sheet or of an aluminium sheet, on which a wear-reducing surface treatment has been carried out.

The balloon control ring 1 is economical to produce and easy to fit. Additional holders are not required. The balloon control ring 1 is stable for the stress occurring from the circulating yam. The balloon control ring 1 shown in the embodiment is formed from a sheet metal strip made of nickel chromium sheet metal, which is 0.4 mm thick. During production of the balloon control ring 1, the two edge strips 8, 9 of the metal strip are firstly folded round and the cylindrical form of the hollow cylinder 2 is then formed with a three-roller machine by means of a rolling process, the surface contour of the rollers being adapted to the contour of the folds. The folded-round edge strip 8, 9 ensures a high degree of stability of the balloon control ring 1.

Figure 4:
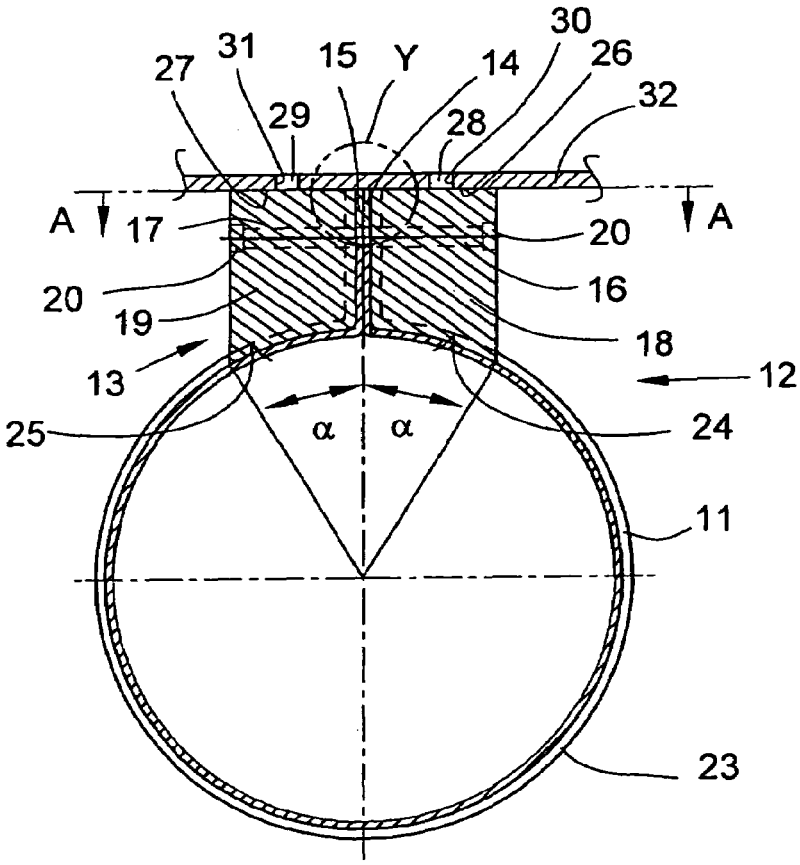
FIG. 4 shows a balloon control ring with a two-piece holding element along the section B-B in plan view.
Figure 5:
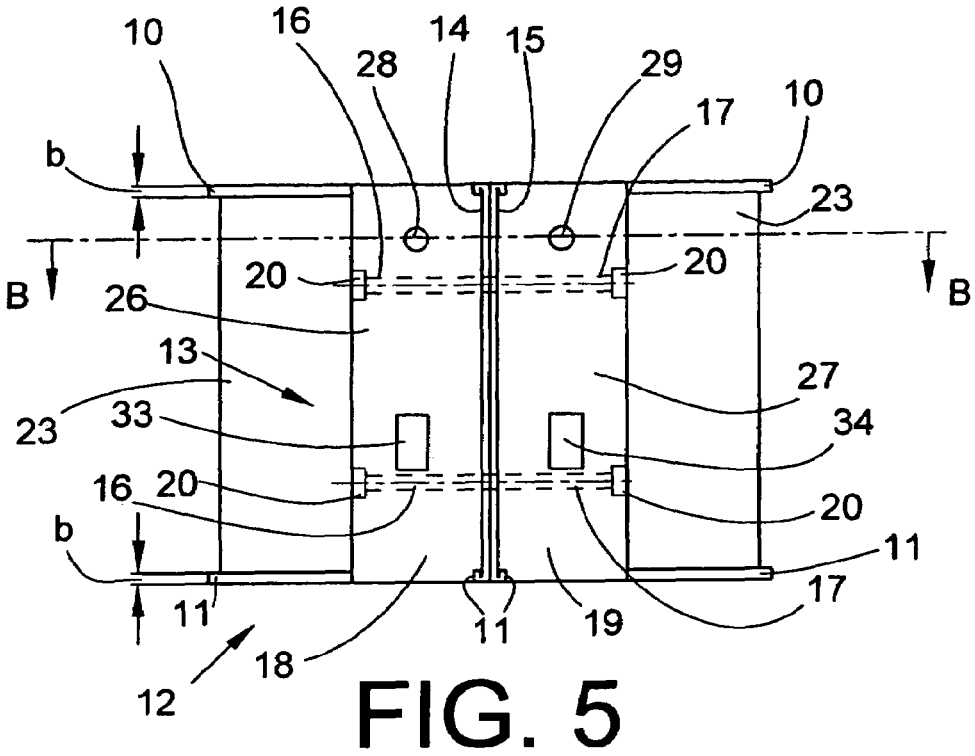
FIG. 5 shows the balloon control ring of FIG. 4 in the view A.
Figure 6:
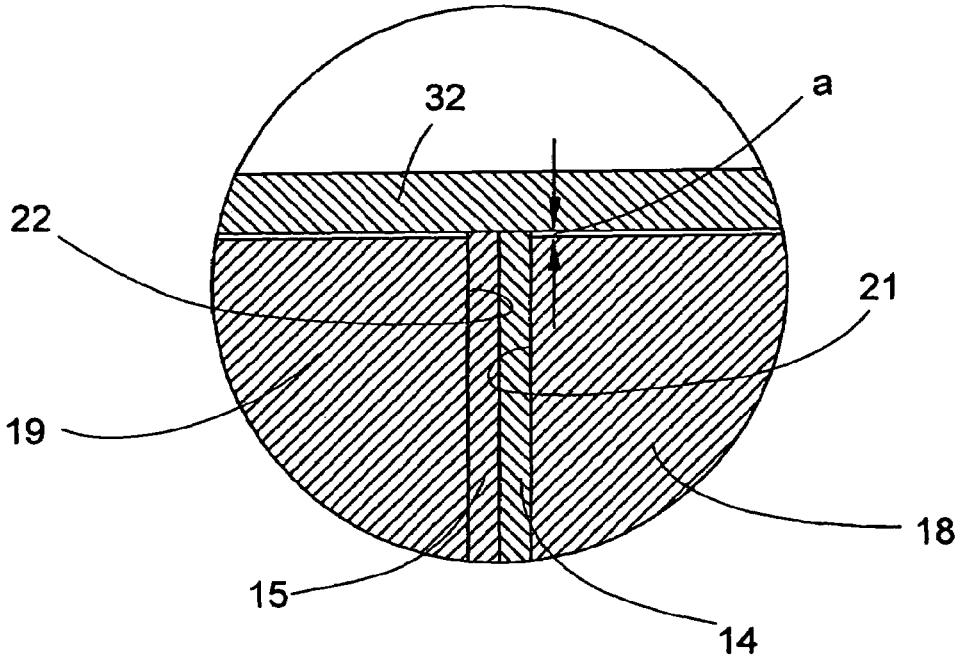
FIG. 6 shows the detail Y from FIG. 4.

FIGS. 4, 5 and 6 show a balloon control ring 12 which is held by a two-piece holding element 13. The balloon control ring 12 shown in the embodiment is formed from a sheet metal strip from nickel chromium sheet metal which is 0.4 mm thick. An edge strip 10, 11 is folded round at the upper and lower edge of the balloon control ring 12. The edge strip 10, 11 may have a width b of 5 mm to 10 mm. The end portions 14, 15 outwardly bent round at right angles are pressed against one another between the two part pieces 18, 19 of the holding element 13. The hollow cylinder 23 is held by the end portions 14, 15 of the sheet metal strip. The part pieces 18, 19 have continuous bores 16, 17 which are flush with one another, through which in each case a connecting element configured as a screw connection 20 engages. A simple screw connection comprises, for example, a screw with a nut. The part pieces 18, 19 in each case abut, with a first level contact face 21, 22, the end portions 14, 15. The pressing power by which the end portions 14, 15 are pressed against one another is produced by tightening the screw connections 20. The part pieces 18, 19 of the holding elements 13 with a concave second contact face 24, 25, in each case, abut the hollow cylinder 23. The curvature of the concave contact faces 24, 25 is adapted to the curvature of the hollow cylinder 23. The hollow cylinder 23 and the holding element 13 have the same height. The length, on which the concave contact face 24, 25 abuts the outer periphery of the hollow cylinder 23 is represented in each case by the angle $\alpha$. In the view of FIG. 4, the angle $\alpha=30°$. Alternatively, the design of the holding element 13 can be selected such that the angle $\alpha$ adopts a value of between 20° and 45°. Due to the concave contact faces 24, 25, the hollow cylinder 23, over its entire height, finds support which stabilises the cylindrical shape of the hollow cylinder 23.

A level third contact face 26, 27 has two positioning cams 28, 29. The positioning cams 28, 29, to position the holding element, engage in bores 30, 31 of the frame wall 32. At least one holding magnet 33, 34 is introduced into the contact faces 26, 27, in each case. The holding magnets 33, 34 adhere to the frame wall 32 and ensure a secure seat of the holding element 13. The holding element 13 is an injection moulding made of plastics material.

The end portions 14, 15 project slightly over the third contact faces 26, 27 of the holding element 13 as shown enlarged for clarity in FIG. 6. This projection designated a is very small and is, for example, 0.1 mm. When the balloon control ring 12 is positioned on the frame wall 32, the projection a of the end portions 14, 15 ensures that the end portions 14, 15 are in contact with the frame wall 32 and an electrically conductive connection is produced between the hollow cylinder 23, and frame wall 32. By means of this electrically conductive connection, the electrostatic charge, which is produced by the friction of the circulating yarn in the hollow cylinder 23, is reliably discharged. An electrostatic charge is undesired as it encourages the disruptive depositing of dust and fibre fly on the inside of the hollow cylinder 23.

Figure 7:
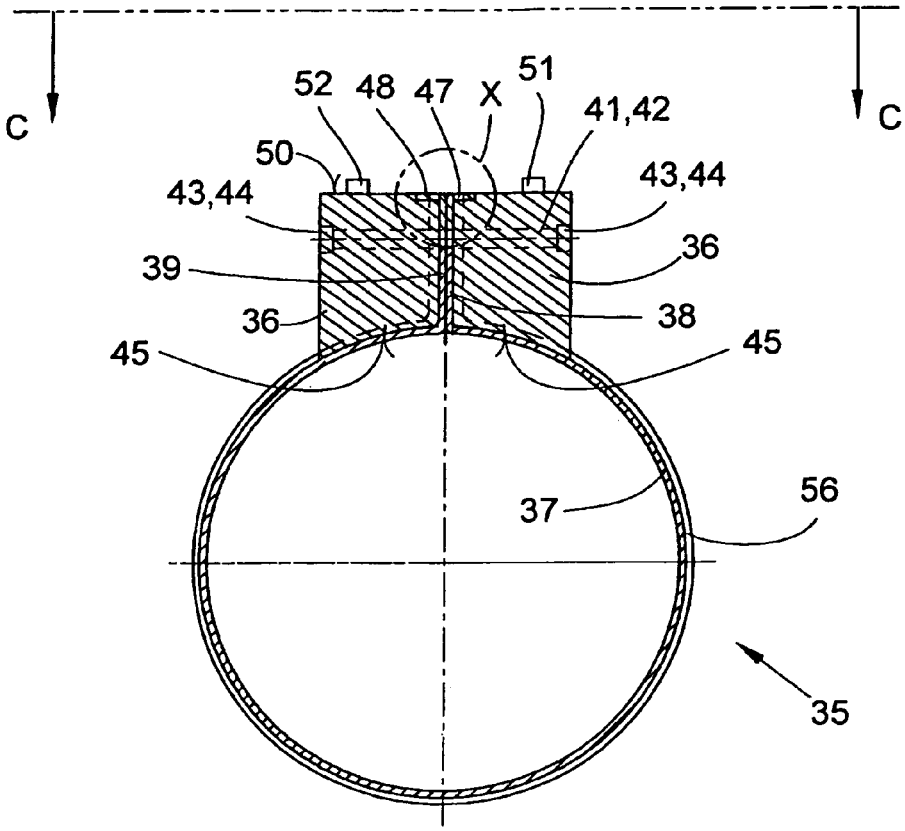
FIG. 7 shows a balloon control ring with a one-piece holding element along the section D-D in a plan view.
Figure 8:
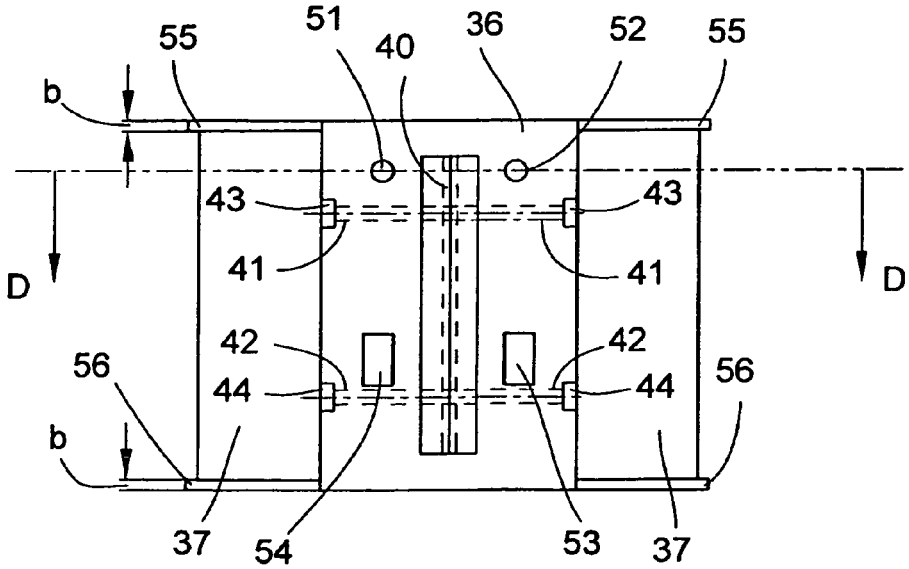
FIG. 8 shows the balloon control ring of FIG. 7 in the view C.

FIGS. 7 and 8 show a balloon control ring 35 with a one-piece holding element 36. An edge strip 55, 56 is folded round in each case at the upper and lower edge of the balloon control ring 35. The edge strip 55, 56 may have a width b of 5 mm to 10 mm. The end portions 38, 39 bent round outwardly at right angles from the hollow cylinder 37 are inserted through the rectangular opening 40, which crosses the holding element 36. The holding element 36 has continuous bores 41, 42 extending transversely to the end portions 38, 39. The screw connections 43, 44 engage through the bores 41, 42. By tightening the screw connections 43, 44, a pressing power is produced by the level contact faces 46 of the holding element 36 and presses the end portions 38, 39 against one another. The holding element 36, with the concave contact face 45 abuts the hollow cylinder 37 and thereby stabilises the cylindrical form of the hollow cylinder 37. The curvature of the concave contact face 45 is adapted to the curvature of the hollow cylinder 37. The length of the end portions 38, 39 is greater than the depth of the opening 40. Once the end portions 38, 39 have been inserted through the opening 40, the ends 47, 48 therefore project beyond the holding element 36. The projecting free ends 47, 48 are then turned over. The turned over free ends 47, 48 then lie in a trough 49 of the holding element 36. The turning over of the ends 47, 48 brings about a secure seat of the hollow cylinder 37 on the holding element 36 and stabilises the balloon control ring 35. A level contact face 50 of the holding element 36 remote from the hollow cylinder 37 has two positioning cams 51, 52. The positioning cams 51, 52 engage, to position the holding element 36, in bores of the frame wall 32 of the textile machine. Two holding magnets 53, 54 are introduced into the level contact face 50 of the holding element 36. The holding magnets 53, 54 adhere on the frame wall 32 and ensure a reliable fixing of the holding element 36. The holding element 36, like the holding 13 shown in FIG. 4, is an injection moulding made of plastics material.

Figure 9:
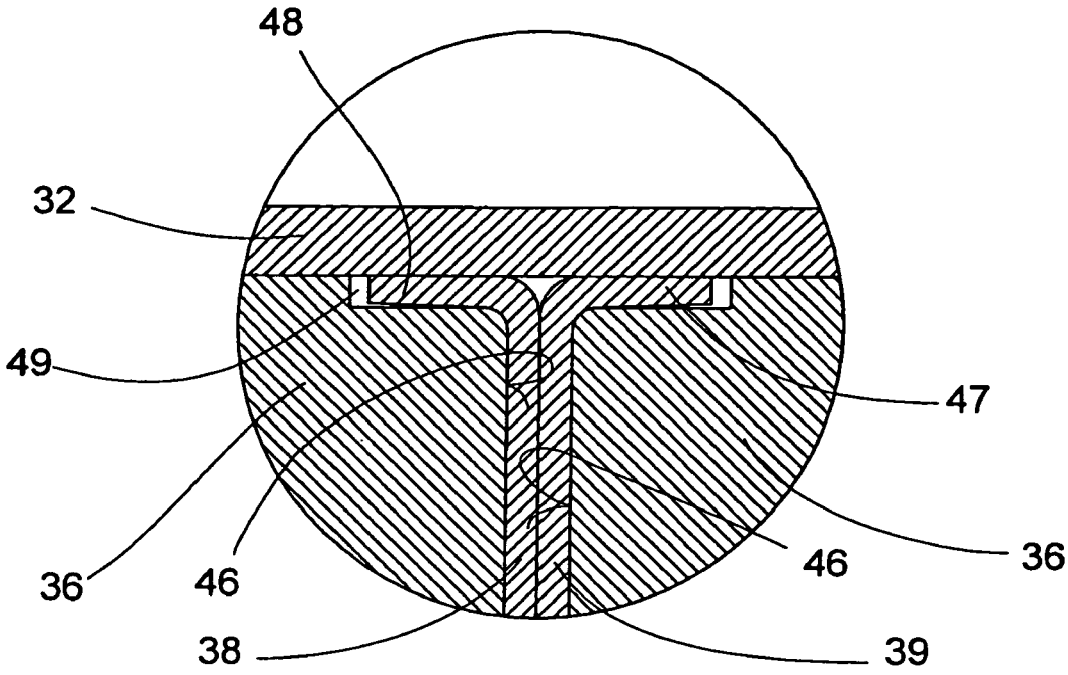
FIG. 9 shows the detail X from FIG. 7.

When the holding element 36 is fixed by means of the holding magnets 53, 54 on the frame wall 32, the turned over free ends 47, 48 contact the frame wall 32, as shown enlarged for clarity in FIG. 9. As a result, an electrically conductive connection, which prevents an electrostatic charge of the hollow cylinder 37, exists between the hollow cylinder 37 and the frame wall 32.

What is claimed is:

1. Balloon control ring for a textile machine for limiting a circulating yarn balloon, the balloon control ring comprising a metallic hollow cylinder with a wear-resistant surface, characterised in that the hollow cylinder (2, 23, 37) is formed from a sheet metal strip, in that the hollow cylinder (2, 23, 37) is held by the end portions (3, 4; 14, 15; 38, 39) of the sheet metal strip, in that an edge strip (8, 9; 10, 11; 55, 56) is folded round at the two edges of the hollow cylinder (2, 23, 37) in each case and that the sheet metal thickness of the sheet metal strip is at most 0.6 mm.

2. Balloon control ring according to claim 1, characterised in that the folded round edge strip (8, 9; 10, 11; 55, 56) has a width b of between 5 mm and 10 mm.

3. Balloon control ring according to claim 1, characterised in that the sheet metal thickness is between 0.3 mm and 0.6 mm.

4. Balloon control ring according to claim 1, characterised in that an end portion (3, 4; 14, 15; 38, 39) is bent round outwardly at the two ends of the sheet metal strip in each case and the two end portions (3, 4; 14, 15; 38, 39) are pressed against one another.

5. Balloon control ring according to claim 4, characterised in that the two end portions (3, 4; 14, 15; 38, 39) are bent round outwardly at right angles in each case.

6. Balloon control ring according to claim 4, characterised in that the end portions (3, 4; 14, 15; 38, 39) contact a frame wall (7, 32) of the textile machine and an electrically conductive connection is produced by the contact.

7. Balloon control ring according to claim 1, characterised in that the balloon control ring (12, 35) is held by means of a holding element (13, 36), which presses the end portions (14, 15; 38, 39) against one another.

8. Balloon control ring according to claim 7, characterised in that the holding element (13, 36) comprises level first contact faces (21, 22; 46), with which it abuts the end portions (14, 15; 38, 39) and presses them against one another, in that the holding element (13, 36) comprises at least one concave second contact face (24, 25; 45), with which it abuts the outer face of the hollow cylinder (23, 37) and in that the balloon control ring (12, 35) is fixed by means of screw connections (20; 43, 44), which cross the holding element (13, 36) and the end portions (14, 15; 38, 39).

9. Balloon control ring according to claim 7, characterised in that the free ends (47, 48) of the end portions (38, 39) are turned over in such a way that they engage behind the holding element (36).

10. Balloon control ring according to claim 7, characterised in that the holding element (13, 36) has positioning cams (28, 29; 51, 52) and holding magnets (33, 34; 53, 54), with which it can be fixed on a frame wall (32) of the textile machine.

11. Balloon control ring according to claim 7, characterised in that the holding element (13, 36) is an injection moulding made of plastics material.

12. Balloon control ring according to claim 1, characterised in that the hollow cylinder (2, 23, 37) is made of stainless nickel chromium steel.

* * * * *